US005882577A

United States Patent [19]

Zacharias

[11] Patent Number: 5,882,577

[45] Date of Patent: Mar. 16, 1999

[54] TUNDISH

[75] Inventor: Donald R Zacharias, Parma, Ohio

[73] Assignee: Foseco International Limited, Wiltshire, United Kingdom

[21] Appl. No.: 860,802

[22] PCT Filed: Jan. 15, 1996

[86] PCT No.: PCT/GB96/00063

§ 371 Date: Jul. 10, 1997

§ 102(e) Date: Jul. 10, 1997

[87] PCT Pub. No.: WO96/22853

PCT Pub. Date: Aug. 1, 1997

[30] Foreign Application Priority Data

Jan. 26, 1995 [GB] United Kingdom ..... 9501516
Mar. 25, 1995 [GB] United Kingdom ..... 9506130

[51] Int. Cl.[6] ..... B22D 41/00

[52] U.S. Cl. ..... 266/45; 266/229; 266/275

[58] Field of Search ..... 266/227, 229, 266/275, 236, 45; 222/594, 590

[56] References Cited

U.S. PATENT DOCUMENTS

| | | | |
|---|---|---|---|
| 5,131,636 | 7/1992 | Soofi | 266/227 |
| 5,133,535 | 7/1992 | Soofi | 266/227 |
| 5,169,591 | 12/1992 | Schmidt et al. | 266/275 |
| 5,188,796 | 2/1993 | Soofi | 266/275 |
| 5,358,551 | 10/1994 | Saylor | 75/584 |
| 5,518,153 | 5/1996 | Zacharias et al. | 266/275 |
| 5,551,672 | 9/1996 | Schmidt | 266/229 |

FOREIGN PATENT DOCUMENTS

| | | |
|---|---|---|
| 0 124667 | 11/1984 | European Pat. Off. . |
| WO 94/11135 | 5/1994 | WIPO . |

OTHER PUBLICATIONS

Isenberg–O'Loughlin, "Dishing it Out" the latest in Tundish Utensils and High–Tech Tableware, Metalproducing, No. 33, Feb. 1996 .

*Primary Examiner*—Scott Kastler
*Attorney, Agent, or Firm*—Nixon & Vanderhye P.C.

[57] ABSTRACT

A tundish of improved flow characteristics for molten metal has an outlet in its base. The outlet is spaced longitudinally of the tundish from a pour zone. The pour zone is positioned to receive a stream of molten steel from a ladle. An impact pad is provided on the floor of the tundish in the pour zone, the impact pad comprising a base having an impact surface, an upwardly extending side wall along the periphery of the base, the side wall having an inner surface with an undercut portion to face the incoming steel stream, and the undercut portion having a surface shape to receive and reverse the direction of flow of the incoming stream. A dam is positioned between the impact pad and the outlet. The dam has one or more holes to allow through-passage of a proportion of the steel, and the dam extends upwardly from the tundish floor about 40–60% of the height of the uppermost level of steel in the tundish.

3 Claims, 3 Drawing Sheets

TUNDISH

This invention relates to a tundish and is particularly concerned to provide a means of improving flow of molten metal through a tundish.

In the continuous casting of steel molten steel is poured from a ladle into an intermediate vessel, a tundish, and from the tundish into one or more continuous casting moulds. For example, the tundish may feed two casting moulds, i.e. it is a two-strand tundish.

It is well known that unwanted non-metallic inclusions can be entrained in the steel in the tundish and a variety of means have been proposed to improve the steel quality by removing such inclusions before the steel passes from the tundish. Such means include the use of a layer of 'active' flux on the surface of the molten steel in the tundish, which flux captures unwanted inclusions. Also, such means include a variety of baffles, dams and weirs positioned in the tundish. In this context. a baffle is an obstruction to steel flow extending from the floor of the tundish to above the uppermost level of the molten steel, a dam is an obstruction protruding upwardly from the floor of the tundish and over which the steel must flow and a weir is an obstruction protruding downwardly into the molten steel and under which the steel must flow.

Such baffles, dams and weirs may be made of, or include a surface layer of an active material, e.g. alumina, to capture inclusions from the steel. They may have holes to allow passage of a portion of the steel through and they may be dimensioned and positioned to urge upward flow of the steel into a better contact with a surface layer of flux material.

Furthermore, it is also known to position an erosion-resistant impact pad on the floor of the tundish to receive the incoming stream of molten steel from a ladle.

Baffles, darts, weirs and impact pads will herein be referred to collectively as tundish furniture.

Impact pads have also been designed to minimise surface turbulence in the tundish in addition to their primary erosion-resistance role. For example, in U.S. Pat. No. 5,169,591, an impact pad is disclosed which has a base to receive an incoming ladle stream and a sidewall extending upwardly alone the periphery of the base. The upwardly extending sidewall includes an inner surface having an undercut portion facing the incoming ladle stream, the undercut portion extending along the length of the inner surface and having a surface shaped to receive and reverse the direction of fluid flow generated by the incoming ladle stream. Molten metal flowing from the impact pad can pass through holes in a baffle located between the impact pad and the outlet from the tundish.

By reducing pour zone turbulence, the risk of the surface covering flux layer being broken and exposing the steel to air can be reduced, thereby reducing levels of steel reoxidation and heat loss.

The present invention aims to provide an improved arrangement of tundish furniture for a tundish that reduces risk of pour zone turbulence and improves flow patterns for steady state casting in the tundish so that inclusion removal can also be improved tundish so that inclusion removal can also be improved and the amount of slag/flux cover layer break up and entrainment at ladle changes can be reduced.

Accordingly, in one aspect the invention provides a tundish having an outlet in its base the outlet being spaced longitudinally of the tundish from a pour zone, the pour zone being positioned to receive a stream of molten steel from a ladle, an impact pad on the floor of the tundish in the pour zone, the impact pad comprising a base having an impact surface, an upwardly extending sidewall along the periphery of the base, the sidewall having an inner surface having an undercut portion to face the incoming steel stream and the undercut portion having a surface shaped to receive and reverse the direction of flow of the incoming stream, and a dam positioned between the impact pad and the outlet, the dam having one or more holes to allow through passage of a proportion of the steel whereby a proportion of the steel can pass through the dam and a proportion of the steel can pass over the dam characterised in that the dam extends upwardly from the tundish floor for from about 40% to 60% of the height of the normal maximum level of steel in the tundish.

In another aspect the invention provides a kit of parts in the form of furniture for a tundish, the kit comprising an impact pad and a dam as defined in the immediately preceding paragraph.

Preferably, the tundish has two outlets longitudinally spaced one on each side of the pour zone and a dam is provided between the pour zone and each outlet.

Preferably, each dam has a pair of holes uniformly spaced across its width and the holes are preferably positioned above the tundish floor with the distance from the floor to the closest edge of the hole being from 25 mm to 50% of the height of the dam. The holes may be of circular cross-section, i.e. the passageways through the dam are cylindrical, although this is not essential, and they may be, for example, of elliptical or other shape.

The holes may extend horizontally through the dam but, in a preferred embodiment, they are angled downwardly, e.g. at an angle of from 30° to 60° to the horizontal from the pour zone side to the outlet side of the dam. In this instance, the heights of the hole centres referred to above are measured on the upstream, i.e. impact pad side, of the dam.

The holes may be, for example, of 5 to 15 cm in diameter for a dam across the full width of tundish, the dam being of height 40 cm and the tundish having a steel working level of 80 cm.

The impact pad may, for example, be of the type disclosed in the aforementioned U.S. Pat. No. 5,169,591. Alternatively, it may be a modified form of impact pad as described in our co-pending U.S. patent application No. 08/338,123, filed 9th Nov. 1994. In that application is described an impact pad having a base and an endless outer sidewall extending upwardly from the base and enclosing an interior space having an upper opening for receiving a stream of molten metal, the outer sidewall including an annular inner surface having at least a first portion extending inwardly and upwardly towards the opening and preferably a second portion extending outwardly and upwardly towards the first portion, whereby a downwardly directed stream of molten metal striking the impact surface of the base is directed outwardly towards the annular inner surface and is then redirected upwardly and inwardly towards the incoming molten metal stream. Also, there is described an impact pad having a base and an endless sidewall extending upwardly from the base, a top surface substantially parallel to the impact surface of the base and connected to the sidewall and defining a non-uniform opening therein, the non-uniform opening having a long dimension and a short dimension perpendicular to the long dimension, the sidewall having an interior face shaped so that molten metal contacting the impact surface flows outwardly then is turned inwardly and directed upwardly by the interior face of the sidewall and then flows out of the opening. In this latter embodiment the opening is intended to be aligned with the long dimension of the tundish.

The optimum positioning and size of the dams relative to the outlets and the pour region will, of course, vary from tundish to tundish but will be readily determinable by the average skilled man of the art who, for example frequently uses mathematical means and/or water-modelling as a means of determining tundish furniture design and positioning.

The invention has been found to provide considerable flow improvements in a tundish. The flow benefits include:

i) increased minimum residence time ii) decreased dead volume iii) increased median residence time iv) increased surface directed flow.

These characteristics all aid improved inclusion removal. Clearly, increased residence time increases likelihood of inclusion removal from the steel. Decreased dead volume reduces those regions of the tundish where flow becomes static thereby reducing temperature homogenisation and making inclusion removal less likely. Increased surface directed flow improves contact between the steel and an active flux covering layer thereby promoting collection of inclusions.

v) Reduced steel re-oxidation is also achieved by reduced turbulence, particularly on pouring steel from a ladle into an empty tundish and during ladle changes during sequence casting. Thus, the use of the particular type of impact pad dampens the energy of the steel poured into the tundish and the reduced turbulence so achieved reduces the exposure of steel to air thereby reducing the formation of oxide inclusions, e.g. alumina and iron oxides, commonly produced during teeming of molten steel.

vi) A reduction is achieved in ladle slag exiting from the tundish outlets.

vii) A reduction is achieved in transitional mixed steel grades (i.e. steels of different chemical constitution), during sequence casting thereby improving yield.

viii) A surface layer of active tundish flux can be used over the entire tundish thereby improving inclusion pick-up.

Moreover, the invention enables a reduction to be achieved in the tundish furniture material required compared to conventional pour pad/baffle systems or pour pad/dam/weir systems.

Embodiments of the invention are now described by way of example only with reference to the accompanying drawings in which.

Figure 1:
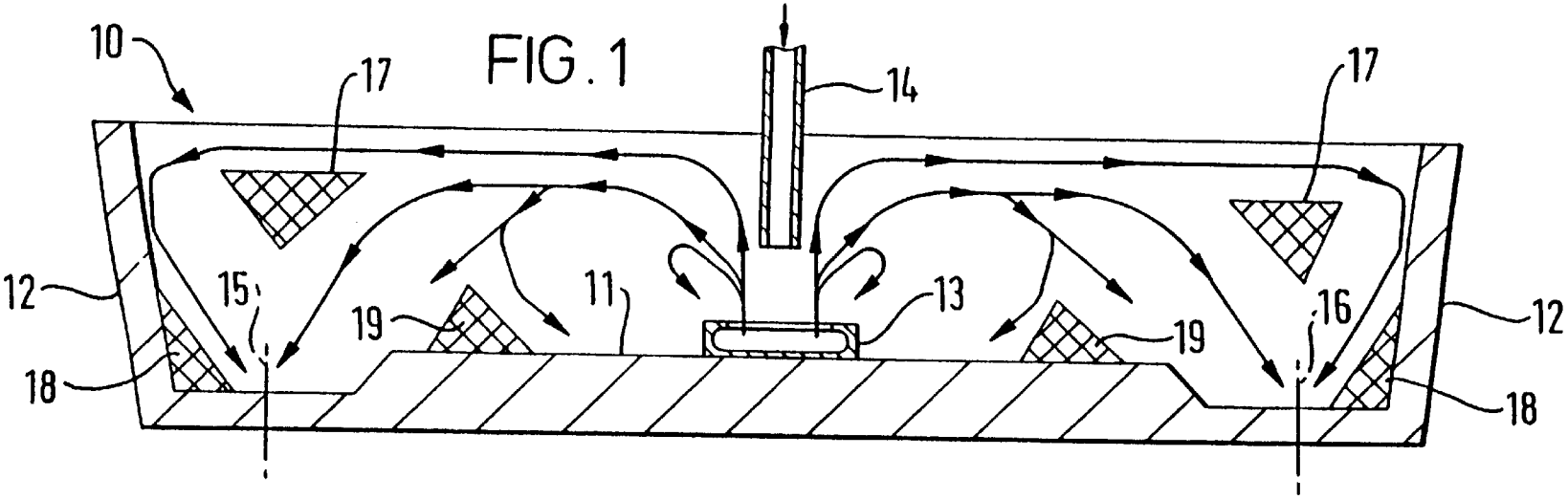
FIG. 1 is a diagrammatic illustration in longitudinal cross-section of a tundish showing the effect on steel flow of an impact pad in the pour zone without the dams used in the present invention.

In FIG. 1, a tundish 10 has a floor 11 and end walls 12. An impact pad 13 is located on floor 11 centrally of the tundish. The impact pad is described in more detail below with reference to FIGS. 5, 6 and 7.

A pour tube 14 from a ladle (not shown) is positioned directly above the impact pad so that steel poured into the tundish will strike the impact pad. The tundish has two outlet regions 15 and 16 spaced towards each longitudinal end of the tundish, the actual outlets in the base of the tundish not being shown.

The arrows show the directions of steel flow, as derived by water modelling on a 0.3 scale tundish model. A number of 'dead zones' where liquid flow was virtually static were revealed, these being numbered 17 (a pair of zones towards the surface of the liquid, one towards each end of the tundish), 18 (a pair of zones, one at each end of the tundish in the angle between the end wall and the floor), and 19 (a pair of zones, each on the floor of the tundish between the impact pad and the outlet regions).

Figure 2:
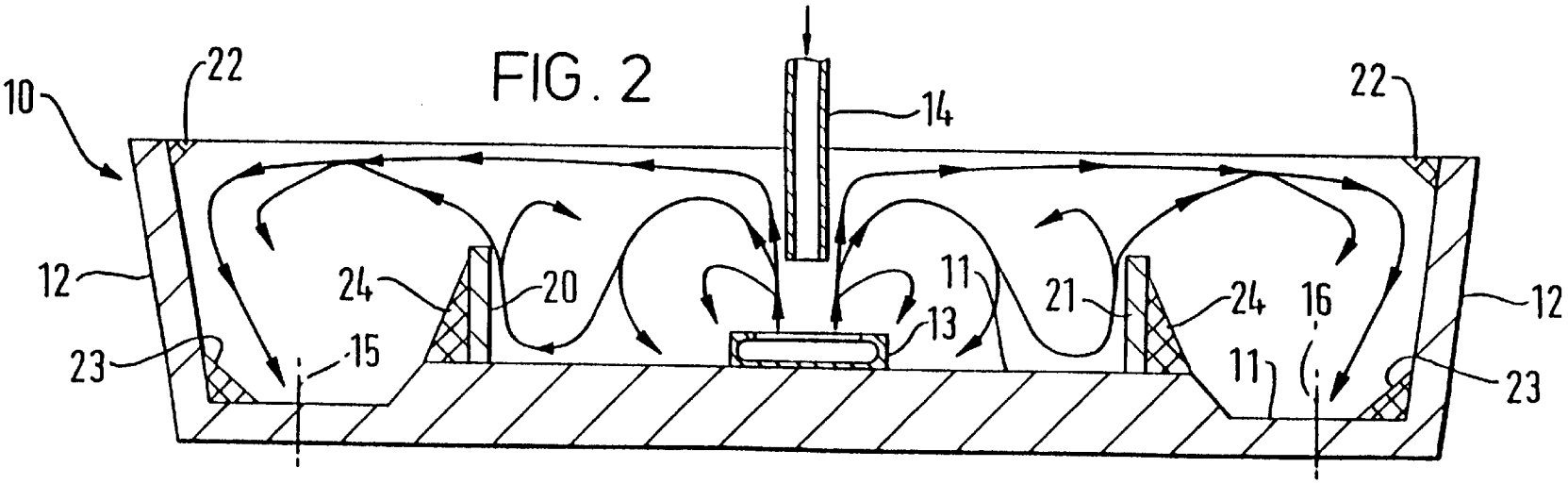
FIG. 2 is a similar view to FIG. 1 showing the effect on steel flow of including both the dams and impact pad of the present invention.

In FIG. 2, where like reference numerals indicate like tundish parts, the tundish furniture has been completed by the addition of two dams 20 and 21, each located approximately 60 to 80% of the distance from the impact pad 13 to its respective outlet. (This distance may vary e.g. from 40% to 80% depending on tundish design and casting conditions.) Each dam, whose construction is described in more detail below with reference to FIGS. 3 and 4, was of height to extend upwardly to about 50% of the normal maximum operating steel level in the tundish.

Again, the steel flow patterns are indicated by arrows as derived by water modelling at 0.3 scale. Again, six 'dead zones' of relatively static flow were revealed but, as can be seen, they were of significantly reduced volume. One pair of zones 22 was found, one at each end of the tundish at the liquid surface. A second pair of zones 23 was found corresponding in position to zones 18 of FIG. 1. A third pair of zones 24 was found, one on the downstream side of each dam 20, 21.

Overall, the steel flow pattern was much improved leading to improved prospects of inclusion removal.

Figure 4:
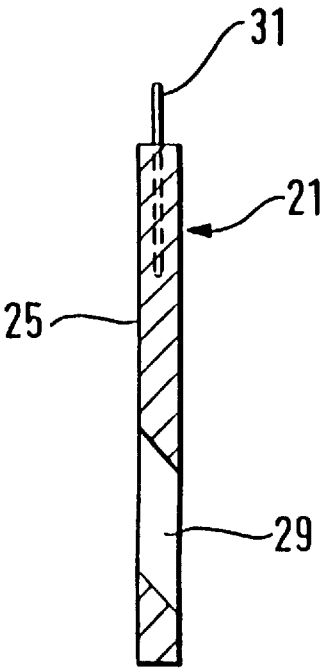
FIG. 4 is a section on line IV—IV of FIG. 3.
Figure 3:
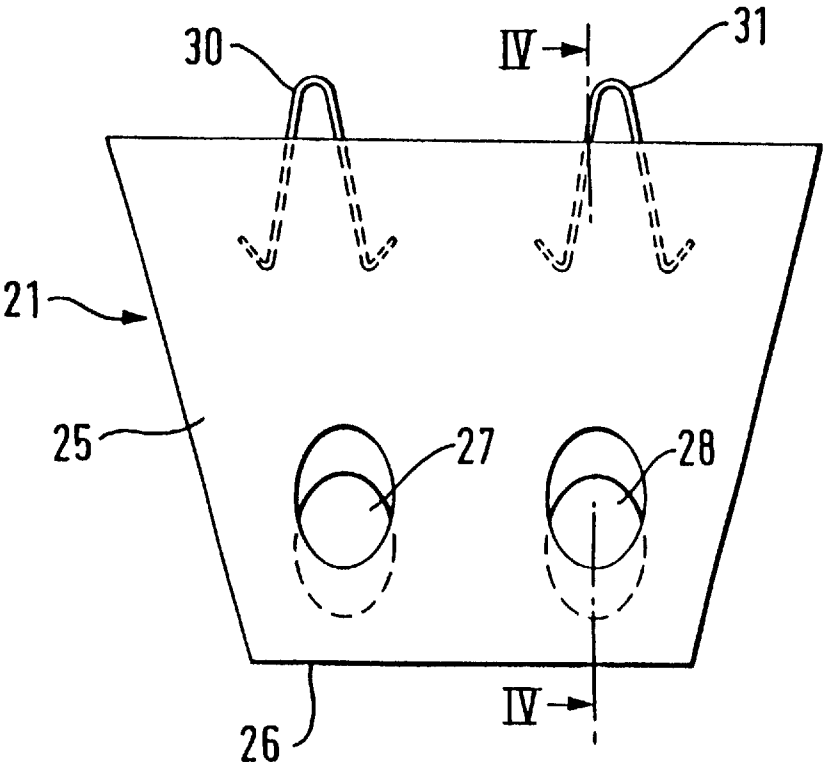
FIG. 3 is an elevation of one dam for use in the invention.

In FIGS. 3 and 4, dam 21 (which is identical to dam 20) has an upstream face 25, i.e. the face nearest the pour zone and impact pad 14. It tapers to a lower edge 26 so as to conform to the walls of the particular tundish it is intended for with edge 26 resting on the floor of the tundish. Two holes 27, 28 pass through the dam forming a passageway 29 angled downwardly at 45° to the horizontal from the upstream to the downstream side.

Two mounting hooks 30 and 31 are cast into the dam 21 during its manufacture and enable the dam to be craned into the desired position in the tundish.

Figure 7:
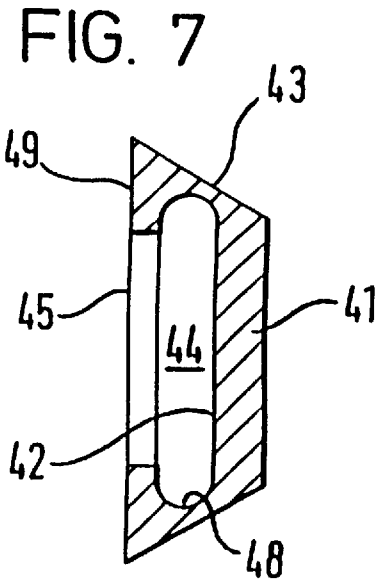
FIG. 7 is a section on line VII—VII of FIG. 5.
Figure 6:
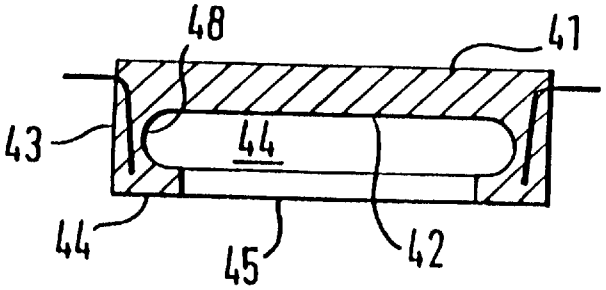
FIG. 6 is a section on line VI—VI of FIG. 5.
Figure 5:
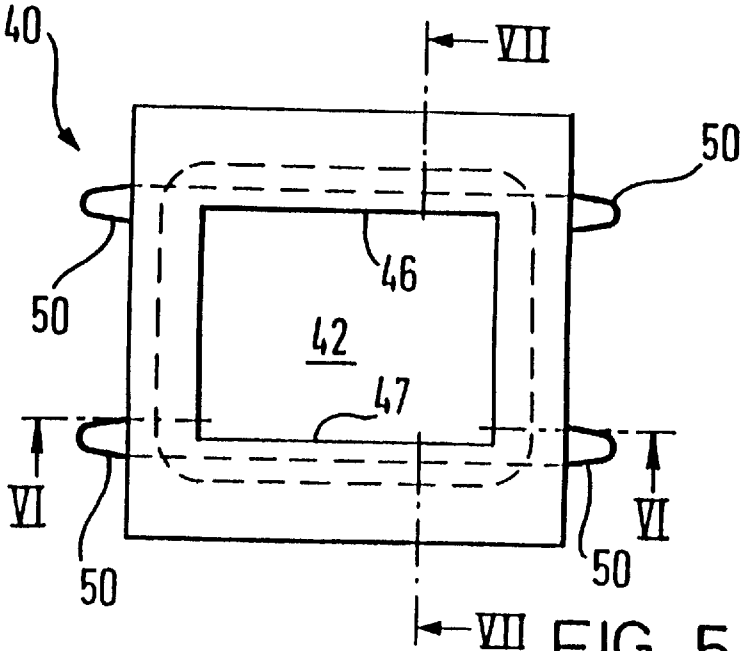
FIG. 5 is a plan view of an impact pad for use in the invention.

The impact pad 40 shown in FIGS. 5, 6 and 7 has a base 41 with an impact surface 42 to receive an incoming stream of molten steel. It is of generally rectangular configuration and has an upstanding sidewall 43 emending continuously around its periphery. The sidewall encloses an interior space 44 having an upper opening 45 to receive the incoming stream. The opening 45 is non-uniform, being rectangular, and its longer sides are positioned to extend in the longitudinal direction of the tundish when the impact pad is positioned on the floor of the tundish. The sidewall 43 is provided with an inner face 48 shaped firstly to extend outwardly and upwardly from impact surface 42 and then inwardly and upwardly to opening 45. The sidewall ends in a top surface 49 surrounding the opening 45 and effectively provides an undercut portion at its inner surface to receive and reverse the direction of steel flow generated by an incoming stream impacting on surface 42.

As shown the pad is provided with four hooks 50 to aid its positioning in the tundish. Again these hooks were cast into the impact pad during its manufacture.

I claim:

1. A method of operating a tundish having a normal maximum operating level of molten steel therein, a floor having an outlet, a pour zone, and side walls extending upwardly from the floor, the side walls extending above the normal maximum operating level of molten steel in the tundish; an impact pad positioned on the tundish floor in the pour zone, the impact pad comprising a base, an impact surface, an upwardly extending sidewall along the periphery of the base, the sidewall having an inner surface with an undercut portion facing incoming steel being poured in a stream into the pour zone, the undercut portion shaped to receive and reverse the direction of flow of the incoming steel stream; the method comprising:

(a) positioning a dam in the tundish on the floor between the impact pad and the outlet, the dam having at least one hole therein allowing the passage of molten steel therethrough, and the dam extending upwardly from the floor a distance between about 40–60% of the normal maximum operating level of molten steel in the tundish;

(b) pouring molten steel in a stream into the tundish pour zone so that the steel impacts the impact surface of the impact pad and so that the undercut portion receives and reverses the direction of flow of the incoming steel stream; and (c) causing the molten steel to flow over the dam and through the at least one hole therein to and out the outlet.

2. A method as recited in claim 1 wherein the dam at least one hole is angled to the horizontal from 30–60°, and wherein step (a) is practiced so as to position the dam so that the at least one hole is angled downwardly from the pour zone to the outlet.

3. A method as recited in claim 1 wherein the dam comprises a first dam, and the tundish outlet comprises a first outlet, and wherein the tundish has a second outlet disposed on an opposite side of the impact pad from the first outlet; and wherein step (a) is further practiced by positioning the second dam in the tundish on the floor between the impact pad and the second outlet, the second dam having at least one hole therein allowing the passage of molten steel therethrough, and the second dam extending upwardly from the floor a distance between about 40–60% of the normal maximum operating level of molten steel in the tundish; and wherein step (c) is practiced to cause the molten steel to flow over the second dam and through the at least one hole therein to and out the second outlet.

* * * * *